United States Patent [19]

Saarinen et al.

[11] Patent Number: 5,033,602

[45] Date of Patent: Jul. 23, 1991

[54] DEVICE FOR INDENTIFYING COINS

[75] Inventors: Tapani Saarinen, Helsinki; Jaakko A. Räsänen, Espoo, both of Finland

[73] Assignee: Inter Marketing Oy, Espoo, Finland

[21] Appl. No.: 399,502

[22] PCT Filed: Mar. 30, 1988

[86] PCT No.: PCT/FI88/00046

§ 371 Date: Sep. 14, 1989

§ 102(e) Date: Sep. 14, 1989

[87] PCT Pub. No.: WO88/07731

PCT Pub. Date: Oct. 6, 1988

[30] Foreign Application Priority Data

Mar. 31, 1987 [FI] Finland ..... 871403

[51] Int. Cl.[5] ..... G07D 5/08

[52] U.S. Cl. ..... 194/334; 194/302

[58] Field of Search ..... 194/212, 302, 334; 453/4

[56] References Cited

U.S. PATENT DOCUMENTS

| | | | |
|---|---|---|---|
| 3,682,286 | 8/1972 | Prumm | 194/334 X |
| 4,217,491 | 8/1980 | Dufford, Jr. et al. | 250/223 R |
| 4,249,648 | 2/1981 | Meyer | 194/212 |
| 4,371,071 | 2/1983 | Abedor et al. | 194/212 |
| 4,509,633 | 4/1985 | Chow | 194/334 |
| 4,531,625 | 7/1985 | Yonekura et al. | 194/334 |
| 4,585,936 | 4/1986 | Sellier | 250/223 R |
| 4,676,358 | 6/1987 | Rosendahl, Jr. | 194/203 |

FOREIGN PATENT DOCUMENTS

| | | | |
|---|---|---|---|
| 2724868 | 4/1977 | Fed. Rep. of Germany . | |
| 3304395 | 8/1984 | Fed. Rep. of Germany . | |
| 3416045 | 10/1985 | Netherlands | 194/334 |
| 3445247 | 6/1986 | Netherlands | 194/334 |
| 397420 | 10/1975 | Sweden . | |
| 974386 | 11/1982 | U.S.S.R. | 194/334 |
| 1379473 | 1/1975 | United Kingdom . | |
| 2054233 | 2/1981 | United Kingdom | 194/334 |
| 2115547 | 9/1983 | United Kingdom . | |
| 2173624 | 10/1986 | United Kingdom | 194/302 |
| 2176038 | 12/1986 | United Kingdom . | |

OTHER PUBLICATIONS

"Methods of High Precision Measuring of Rotationally Symmetrical Components for Production and Quality Assurance Provisions; Part 1: Outside Diameter Measurement Techniques", by G. Klotz, *Technisches* Messen tm, 54, Jahrgang, Heft 5/1987.

*Primary Examiner*—Robert J. Spar
*Assistant Examiner*—Scott L. Lowe
*Attorney, Agent, or Firm*—Lyon & Lyon

[57] ABSTRACT

A device for electronically identifying coins, or the like, is described in which coins fed along a feed path are illuminated by light passed from a light source essentially perpendicularly to the feed path. A photosensitive sensor receives the light which passes the coin and converts it to an electric signal representative of the coin diameter. The device utilizes a column-like light source and a lens assembly intermediate the coin and the sensor whereby the size requirements of the sensor are reduced.

1 Claim, 1 Drawing Sheet

DEVICE FOR INDENTIFYING COINS

BACKGROUND OF THE INVENTION

This invention relates to a device for identifying coin type articles, encompassing all of the coin types known to those of ordinary skill in the art on the basis of the diameter thereof, comprising a coin path for feeding coins;

a light source for illuminating the coin on the path in a direction essentially perpendicular to the plane of the path; and a photosensitive sensor for converting the light which passes the coin into an electric signal dependent on the diameter of the coin, or the like.

In coin identification devices of the above type, the light receivers are formed, either by optic fibres the ends of which are arranged at suitable heights in accordance with the diameters of the different coin types, or by columns consisting of photodiodes or some other photosensitive elements. These kinds of devices for determining the diameter of a coin, are known e.g. from British Patent Applications 2 115 547 and 2 176 038 and British Patent specifications 1 379 473 and U.S. Pat. No. 4,249,648. The use of a sensor according to British Patent Application 2 176 038 requires that the coin be in contact with the path when it passes the sensor. On the other hand, this kind of sensor arrangement merely enables the different coin types to be separated from each other, whereas foreign coins, for instance, which fall between these coin types are included in the group of the next smallest coin type, and it is not possible to exclude them from the counting. Further, when this kind of device is modified so as to be operative with another country's coins, a new basic adjustment is required, i.e. the fibres have to be arranged at suitable heights through experimentation. The devices disclosed in British Patent Application 2 115 547 and British Patent Specifications 1 379 473 and U.S. Pat. No. 4,249,648 utilize photodiode rows, by means of which the size of a coin or some other object can be determined on the basis of the number of photodiodes shadowed by the coin. The sorting accuracy of devices of the above type could possibly be improved by increasing the number of the fibres or photodiodes, whereby, in theory, it would be possible to determine the diameter very accurately. In practice, however, the formation of a measuring sensor consisting of a great number of fibre ends or photodiodes is difficult and, in any case, causes considerable costs on account of the complicated structure as well as requiring the detector to be attached to each fibre or photodiode.

Swedish Patent Specification 397 420, in turn, discloses apparatus capable of identification of coins, or the like, on the basis of the area thereof. In a device according to this publication the light receiver consists of a large-area sensor formed by four solar cells, by means of which sensor the area of the coin can be determined on the basis of the total amount of light gone passing the measuring point at the measuring moment. For obtaining a correct measuring result, there must not be more than one coin at a time within the measuring area, which, retards considerably the operation of the device. Moreover such a device has to be provided with means for preventing more than one coin entering the measuring area. In addition, the calibration of the responses of the different parts of the large-area sensor in such devices is also difficult, if not impossible.

SUMMARY OF THE INVENTION

The object of the present invention is to provide meter of coins with an accuracy such that coins having a different diameter can be removed from the coin path. More precisely, the object of the invention is to provide a measuring device sufficiently accurate, in view of coin manufacturing tolerances and other factors affecting the coin diameter that it enables an accurate determination of the diameter of coins. A further object is to solve the problems which have occurred in connection with prior optically operating devices for the determination of coin diameters and devices derived therefrom in view of the costs, reliability, and complicated structure.

The above objects are achieved by means of a device according to the invention, which is characterized in that the light source is column-like; that a lens assembly is arranged in front of a photosensitive sensor, behind the coin path, for projecting an image of the light source onto the sensor; and that the sensor is effective to measure the amount of light by converting the light in the light emitted column by the light source and passing the coin into an electric signal whose value is dependant upon the diameter of the coin. Thus the diameter of the coin, is determined as the difference between the measured signal value of the sensed light amount of an empty path and the minimum signal value produced by the light measured during the passage of a coin. When this kind of measuring principle is used, the coins need not be in contact with the coin path, as the measurement is based only on the amount of light which is able to pass the coins when they traverse the measuring point.

By disposing a lens assembly in front of the sensor, to measure the amount of light and for projecting the image of the light source onto the sensor, the sensor may be smaller than the light source and, thus, more advantageous in cost. Furthermore, the lens assembly in the present organization is able to protect the sensor against dust, which feature is significant as dust formation is a major problem with optic fibres.

In the device according to the invention, variations in the luminosity of the light source due to aging or voltage variation, for instance, are compensated by the column-like light source that comprises two superposed column elements which are equal in size and in which the light amount emitted therefrom of which is separately adjustable for the calibration of the readings given by the sensor measuring the total amount of light. Thus, it is always possible to standardize the measuring situation irrespective of possible variations in the sensitivity of the sensor or due to dust accumulation on the lens assembly.

DESCRIPTION OF THE DRAWINGS

In the following the device according to the invention and its operating principle will be described in more detail with reference to the attached drawing, in which the single FIGURE depicts a schematic illustration of the device according to the invention.

DESCRIPTION OF A PREFERRED EMBODIMENT OF THE INVENTION

Figure 1:
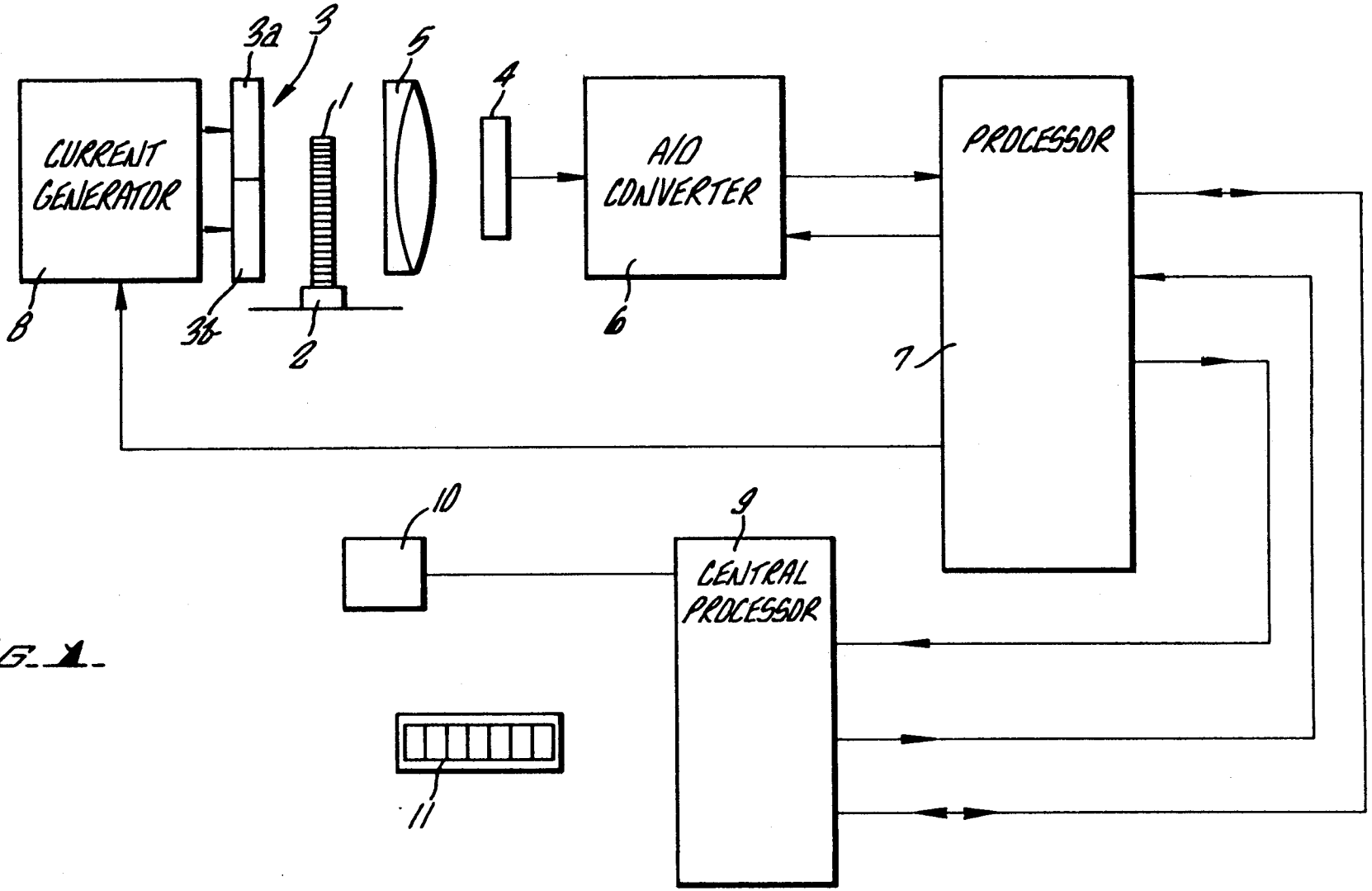

The drawing FIGURE shows generally the structure of the device according to the invention in which the measuring arrangement thereof comprises a coin path 2 on which a coin 1 is shown; a light source 3 positioned on one side of the coin; and a lens assembly 5 and a photosensitive sensor 4 opposite to the light source and behind the coin. As the column-like light source 3 is positioned in an upright position in front of the coin path 2 and an image of the light source is projected through a vertically elongated slit in the housing containing the light source or in the wall of the member defining the coin path and the lens assembly 5 to the sensor 4 measuring the total amount of light on the other side of the coin path, the light source is covered by the corn when it passes along the path in an amount corresponding, in a maximum case, to the diameter of the coin, and the difference between the maximum and minimum amount of light corresponds to the diameter of the coin. That portion of the light column which is covered by the coin is independent of the vertical position of the coin on the path, so the coin need not be in contact with the path 2 at the measuring moment. The coin 1 is illuminated in a direction essentially perpendicular to the plane of the coin path, i.e. the plane of the coin 1. The function of the coin path 2 is to feed the coins to the measuring means essentially in the desired plane and separately from each other. Thus, the coins need not be passed one by one on to the path, which would result in too low a counting rate. In the device according to the invention it is necessary to insure that the coins are not positioned side by side on the path, but this requirement relatively easy to effect mechanically, whereby collisions along the path can be regarded to belong to the normal operation of the device. Even when such collisions result in a coin being moved off the surface of the path at the measuring point, the measuring accuracy is not affected due to the operating principle of the device according to the invention.

The use of the lens assembly 5 enables the light column 3 to be projected to the photosensitive sensor 4 in a smaller size, whereby the sensor may be e.g. a PIN diode. A signal proportional to the total amount of light from the light column 3 is converted into an electric signal and passed from the photosensitive sensor to an A/D converter 6 for converting the measuring value to a digital value. The converter 6 may be e.g. an 8-bit A/D converter. From the converter 6 the digital measuring values are transferred to a processor 7 which carries out the calculations with the measuring values and calibrates the measuring arrangement. When the amount of light at the sensor 4 exceeds a predetermined level for a certain period of time, the processor 7 detects that the path 2 is free and compares the voltage level of the sensor 4 to a level set at the manufacturing stage of the device and corrects a current generator 8 of the light source 3 in a corresponding way. The correction to be carried out at one time is so small that the sawing or hunting effect caused by the adjustment does not cause an error in the end result but it merges into the disturbances and noise occurring in the system in any case. Thus, the correction can be made in parallel with the normal calculation process and, in practice, correction is carried out continuously between measurement of the coins, being interrupted only for the time of the proper measuring.

The column-like light source 3 comprises two separate column elements, such as two LED columns 3*a* and 3*b*. It is also possible that, due to manufacturing inaccuracies, different amounts of light are obtained from the different LED columns with the same current, and the amount of light does not necessarily change in the same way with the ageing of the LEDs. Even though the columns could be made equally luminous at the manufacturing stage of the device, the situation does not necessarily remain unchanged when the device ages.

Since the junction point of the LED columns 3*a* and 3*b* is positioned in the middle of the centre of the lens assembly 5, the images formed at the photosensitive sensor 4 by both the columns are equally large. Also the light amount of the LED columns 3*a* and 3*b* can be adjusted to the same value simply by selectively extinguishing the light emitted from the columns respective and by defining the different between the set values of the columns, the difference being then maintained during normal measuring. This kind of balancing of the light amounts of the LED columns is preferably carried out each time the current to the device is switched on. After the balancing, the light amount of the bottom, i.e. the empty path is set to a certain predetermined value, which is again carried out by means of the current generator 8. In this way one calibration point of the measuring device can be calibrated. The other calibration point is obtained by thereafter extinguishing the lower column, so that an artificial measuring situation is obtained which corresponds to a coin 1 passing along the coin path 2 and having a diameter equalling in size with the lower LED column 3*b*, and by comparing the light amount thus obtained to a value stored in the permanent memory at the calibration stage of the device. If this comparison reveals an essential difference between these values, the operation of the device is faulty. In this way the device, itself, is able to detect even a relatively small malfunction of the measuring system.

The processor 7 carries out the calculation of a numerical value representing the diameter of the coin, or the like. When the amount of light from the sensor 4 falls below a predetermined level, the processor 7 starts to form a moving average from the last 16 samples, simultaneously storing samples in the memory for later examination. The moving average is determined in two parts, the first part being formed by the first eight samples and the second part by the last eight samples in this group of sixteen samples When the average value of the group of the first eight samples becomes smaller than the average value of the group of the last eight samples, the amount of light has reached a minimum value thereof and starts to grow again. The last sample of the group of the first eight samples is thus nearest to the maximum diameter of the coin, or the like. In order to improve the sorting accuracy of the measuring arrangement, the sum of a number of samples, in practice 30 to 40 samples, taken before the sample representing the maximum diameter, which sample is included, is calculated and the sum so obtained is divided by a figure depending on the number of the samples. In this way it is possible to eliminate the dependence of the obtained value on the path velocity of the coins. In practice, a sorting capability of 0.05 mm is obtained when an 8-bit A/D converter 6 is used. This can be regarded as fully sufficient, taking into consideration the manufacturing tolerances of the coins and the diameter variations occurring therein in use. The sampling interval, for example, may be e.g. 200 microseconds. Thereby the moving average is determined for a time of 3.2 milliseconds. Accordingly, the point representing the maximum diameter of the coin is available 1.6 milliseconds after the middle point of the coin has gone past the measuring point. When the time required for the treating of the values in the processor, e.g. 4.4 milliseconds, is added thereto, the device is capable of determining the diameter of the coin six milliseconds after the middle point of the coin has gone past the sensor 4. Since the number of the samples obtained from each coin also depends on the path velocity of the coin, the moment when the coin is positioned by a sorting/rejecting unit 10 on the path can be determined by means of the path velocity. Thus, a coin can be removed reliably from the path if it is detected that its diameter deviates from that of the coins for which the device has been calibrated So it is easy to remove foreign coins from the counting process. The sorting/rejecting unit 10 is controlled by a central processor 9 which receives information from the processor 7 on the diameters and velocities of the coins detected on the path. The central processor 9 then either sorts out the coin to an acceptable coin type on the basis of the diameter data and adds the monetary value of this coin to the sum shown on a display 11, or controls the sorting/rejecting unit 10 so as to remove from the path 2 a coin which does not belong to any one of the acceptable coin types.

Since the operation of the device according to the invention is based on the measurement of the amount of light and, on the other hand, on typical measuring values determined for each coin type by means of this kind of measurements, there is no problem in modifying the counter so that it suits species of coins of different countries. When the,. monetary values of the coins of a new country are input to the device, the number of the coins and the corresponding values are first programmed in the device, whereafter a calibration run is carried out, in which a certain number of each coin type is passed through the device. The device forms coin groups, the average value of which is calculated and the upper and lower acceptable limits are determined for each type by giving the mechanical tolerances of the coins of the country in question.

The device according to the invention has been described above only on the basis of one specific embodiment, and it is to be understand that it is possible to modify the structure of the device as well as the ways of calculating the measuring values dependent on the coin diameter without deviating from the scope of protection defined in the attached claims. Since the device according to the present invention is based on the identification of coins, or the like, exclusively on the basis of the diameter thereof, it is obvious that it does not give fully reliable information on whether all the coins fed into the device are genuine. This information can be ascertained by additional units provided in front of or behind the device, the operation of which devices may be based on the determination of the thickness, for instance, or on the determination of the material of the coin by means of an inductive method. Accordingly, by combining the device according to the invention to units previously known from coin sorting a device can be obtained which both identifies the genuineness of the coins and calculates the value thereof extremely reliably.

We claim:

1. A device for the identification of coins on the basis of the diameter of the coins, comprising:

a coin path (2) for feeding coins (1);

a column-like light source (3) comprising two superposed columkn elements (3*a*, 3*b*), equal in size, for illumianting a coin (1) on the coin path (2) in a direction essentially perpendicular to the plane of the coin path (2);

a photosensitive sensors (4) that measures the amount of light sent by the column-like light source (3) that passes the coin (1) to convert this light into an electric signal dependent on the diameter of the coin; and a lens assembly (5) arranged in front of the photosensitive sensor (4) and behind the coin path (2) for projecting an image of the light from the column-like light source (3) that passes a coin (1) onto the photosensitive sensor (4);

wherein the amounts of light from the column elements (3*a*, 3*b*) of the column-like light source (3) are separately adjustable to permit calibration of the readings given by the photosensitive sensor (4) measuring the amount of light.

* * * * *